US005124724A

United States Patent [19]

Hatakeyama et al.

[11] Patent Number: 5,124,724

[45] Date of Patent: Jun. 23, 1992

[54] COLOR THERMAL PRINTER

[75] Inventors: Atsushi Hatakeyama, Tokyo, Japan; Wayne F. Niskala, Rochester, N.Y.

[73] Assignee: Eastman Kodak Company, Rochester, N.Y.

[21] Appl. No.: 762,102

[22] Filed: Sep. 18, 1991

[51] Int. Cl.[5] ..... B41M 5/34; B41J 2/325

[52] U.S. Cl. ..... 346/76 PH; 400/120; 346/134; 346/136

[58] Field of Search ..... 346/76 PH, 134, 136; 400/120

[56] References Cited

U.S. PATENT DOCUMENTS 4,829,320 5/1989 Une et al. ..... 346/76 PH
4,985,711 1/1991 Nakamura et al. ..... 346/76 PH

FOREIGN PATENT DOCUMENTS 0199667 8/1988 Japan ..... 346/76 PH
0224978 1/1989 Japan ..... 346/76 PH

*Primary Examiner*—Benjamin R. Fuller
*Assistant Examiner*—Huan Tran
*Attorney, Agent, or Firm*—William F. Noval

[57] ABSTRACT

A color thermal printer in which the positioning of the paper in the vicinity of the transfer section is precisely controlled while the paper is being transported and printed. Thus good registration of the various colors used is ensured and the printable area of the paper is enabled to be extended. At the same time, the strain on the thermal print head is minimized by using only the amount of contact pressure required to perform the printing.

3 Claims, 5 Drawing Sheets

COLOR THERMAL PRINTER

BACKGROUND OF THE INVENTION

1. Field of the Invention

The present invention relates to a color thermal printer in which heat from a thermal print head is used to transfer ink from an ink transfer medium to a print medium such as paper. More particularly, it relates to a color thermal printer in which color printing is effected by reciprocally moving the paper within a prescribed range.

2. Description of the Prior Art

In a color thermal printer, a print medium such as paper, for example, together with an ink transfer medium (hereinafter referred to as "ink donor film") are transported through the space between a thermal print head and a platen roller while heat is applied by the thermal print head to effect printing by transferring ink from the ink donor film to the paper.

FIGS. 5 and 6 show examples of the arrangement of conventional color thermal printers. With reference first to FIG. 5, which shows a color thermal printer that employs a reciprocating paper transport system, printing paper 10 is pinched between two sets of pinch rollers 12 and 14 and is moved backwards and forwards by the rotation of these pinch rollers. Between the pinch rollers 12 and 14 is a transfer section constituted by a gap between a platen roller 16 and a thermal print-head 18 through which the paper 10 passes. Under the paper 10 as it passes through the transfer section is an ink donor film 20 which is moved in unison with the movement of the paper 10 by the rotation of film rollers 22 and 24. Heat from the thermal print-head 18 is used to selectively transfer ink from the ink donor film 20 to the paper 10 located between the platen roller 16 and the thermal print head 18.

FIG. 6 illustrates a color thermal printer in which the paper 10 is moved in only one direction by a rotational mechanism. Here the platen roller is constituted by a platen drum 28 which is provided with a gripper 30 for clamping the paper 10 to the surface of the platen drum 28. Film rollers 22 and 24 are to transport the ink donor film 20.

The operation of the printer arrangements shown in FIGS. 5 and 6 will now be described. With reference first to FIG. 5, the paper 10 is moved by the rotation of the pinch rollers 12 around the platen roller 16 and through the transfer section between the thermal print head 18 and the platen roller 16. The transport of the paper 10 is continued to bring the leading edge of the paper through the second set of pinch rollers 14. During this part of the operation the thermal print head 18 is retracted away from the platen roller 16 and the ink donor film 20 is wound on until it is in the prescribed position.

Next, the thermal print head 18 is held against the platen roller 16 at a prescribed pressure and the thermal transfer printing process begins. During the thermal printing process the paper 10 is supported by the frictional force of the pinch rollers 12 and is printed as it is transported in the direction indicated by the arrow 100 by the rotation of the pinch rollers 14 and the platen roller 16. The rotation of the pinch rollers 12 and 14 is synchronized with the rotation of the platen roller 16 to keep the paper 10 smooth and taut, and the ink donor film 20 is wound onto the film roller 22 at a rate which matches the transport speed of the paper 10. At the point at which the transfer of a color is completed, the trailing edge of the paper 10 has to stay held between the pinch rollers 12.

To print the next color, the paper 10 has to be moved back to a predetermined print start position. This comprises retracting the thermal print head 18 away from the platen roller 16 and moving the ink donor film 20 to a prescribed position at which the ink of the desired color is located. During this operation the paper 10 is wound back to the print start position in the direction indicated by the arrow 200, by the reverse rotation of the pinch rollers 12 and 14. At the print start position the leading edge of the paper 10 remains held between the pinch rollers 14.

Each color is thus thermally transferred, i.e. printed, by the above sequence of operations, so completion of a color printing is effected by repeating this sequence of operations a number of times which corresponds to the number of colors which have to be transfer-printed. A three-color printing of yellow, magenta and cyan, for example, would be accomplished by repeating the above sequence of operations three times.

Next, with reference to the operation of the conventional apparatus illustrated by FIG. 6, with the paper 10 held in position on the platen drum 28 by the gripper 30 the platen drum 28 is rotated until the print start position is reached, during which time the thermal print head 18 is maintained in a position of retraction from the platen drum 28 while the ink donor film 20 is moved on to bring it to the necessary position for the start of the transfer printing. After the rotation of the platen drum 28 is thus stopped at the print start position, the thermal print head 18 is brought into contact with the platen drum 28 at a prescribed pressure and the ink transfer begins. The printing of a color is completed when the platen drum 28 has described one revolution in the direction indicated by the arrow 300, following which the next color is transferred by another revolution of the platen drum 28 in the direction indicated by the arrow 300, starting from the print start position. Thus, a three-color transfer printing operation involves three such revolutions by the platen drum.

The conventional color thermal printers described above have the following drawbacks. In the case of the reciprocating system illustrated in FIG. 5, the paper 10 is supported and transported by the frictional force of each of the two sets of pinch rollers 12 and 14. To ensure that the paper 10 is maintained in a state of tension during its transportation, the pressure and frictional force of each of the sets of pinch rollers 12 and 14 have to be maintained at a constant level, for which a separate means of adjustment is needed. Also, the paper 10 has to be positioned precisely to achieve good registration of the second and subsequent colors, but with these conventional color thermal printers the detection and alignment of the paper 10 needed for such precise positioning are difficult.

In addition, for the paper 10 to be moved reciprocally while being printed with a plurality of colors, the paper 10 has to be held throughout by the pinch rollers 12 and 14. In turn, this means that the length of the paper 10 that can be printed by the thermal print head 18 is limited to the length of the paper 10 minus the length of the portions from each of the sets of pinch rollers 12 and 14 to the platen roller 16.

The unidirectional transport system used in the color thermal printer shown in FIG. 6 is arranged so that the transfer of each color is effected with one revolution of the platen drum 28, which resolves the positional alignment problem of the apparatus of FIG. 5. On the other hand, however, the diameter of the platen drum 28 has to be set according to the length of the paper 10, so any increase in the length of the paper 10 has to be matched by a corresponding increase in the diameter of the drum 28, and hence in the drum's radius of curvature. This makes the transport mechanism larger, while the thermal print head also has to be larger to match the larger drum. Thus, the end result is an increase in the cost and size of the apparatus.

Moreover, increasing the radius of curvature of the platen drum 28 also increases the area of contact between the thermal print head 18 and the platen drum 28, spreading the applied contact pressure over a larger area. As a result, the thermal print head 18 has to be pressed against the platen drum 28 with a very strong force in order to produce good-quality printing, and extended use of the thermal print head 18 at these higher pressures making the heating elements of the print head more prone to damage and shortens the life of the print-head.

SUMMARY OF THE INVENTION

To overcome the drawbacks of the prior arrangements described above, the present invention provides a color thermal printer in which the positioning of the paper from the vicinity of the transfer section is controlled with good precision while the paper is being transported and printed to thereby ensure good color registration and extend the printable area of the paper, while at the same time the thermal print head is protected from damaging pressure and therefore lasts longer.

The color thermal printer according to a feature of the present invention comprises a printing section constituted by a platen roller and a thermal print-head arranged in opposition to the platen roller, an ink donor film provided with a plurality of colored inks which passes through a transfer section space between the platen roller and the thermal print head, superposed on a paper print medium with which the ink donor film is moved in unison, the thermal print head being used to selectively transfer the inks of the ink donor film to the paper, a rotatable paper transport means formed by an endless belt which runs between the platen roller and a support roller arranged parallel to the platen roller from which it is spaced by a prescribed distance, a gripper for releasably gripping the paper and the part of the belt of the paper transport means on which the paper is transported, and a gripper moving means which provides positional control of the gripper within a prescribed range from the vicinity of the transfer section; wherein the gripper is used to grip the paper and the belt of the paper transport means while being moved by the gripper moving means so as to thereby transport and print the paper.

With the color thermal printer thus arranged a separate platen roller is provided for the printing, in contrast to the conventional arrangement illustrated in FIG. 6 in which the paper is in direct contact with the platen drum for the printing. This enables the radius of curvature of the platen roller to be set in accordance with the printing pressure requirements of the printing section of the thermal print head. That is, by decreasing the diameter of the platen roller the contact area between the thermal print head and the platen roller is reduced and the pressure is concentrated on the portion needed for the printing. This enables the necessary pressure for good-quality printing to be maintained while reducing the amount of pressure exerted on places where it is not needed, which protects the thermal print head from damage and extends the life of the print head.

Also, a large printing area is provided by the fact that the paper and the belt are held by the gripper and printed while being transported a prescribed distance from the vicinity of the transfer section by the gripper moving means. Furthermore, the ability to control accurately the transport position of the paper enables the printing to be performed with a high degree of precision, so that even when the colors of a color printing have to be printed in a series of separate passes, one for each color, a high degree of color registration accuracy is obtained. Further features of the invention, its nature and various advantages will become more apparent from the accompanying drawings and the following detailed description of the invention.

DETAILED DESCRIPTION OF THE PREFERRED EMBODIMENTS

Figure 1:
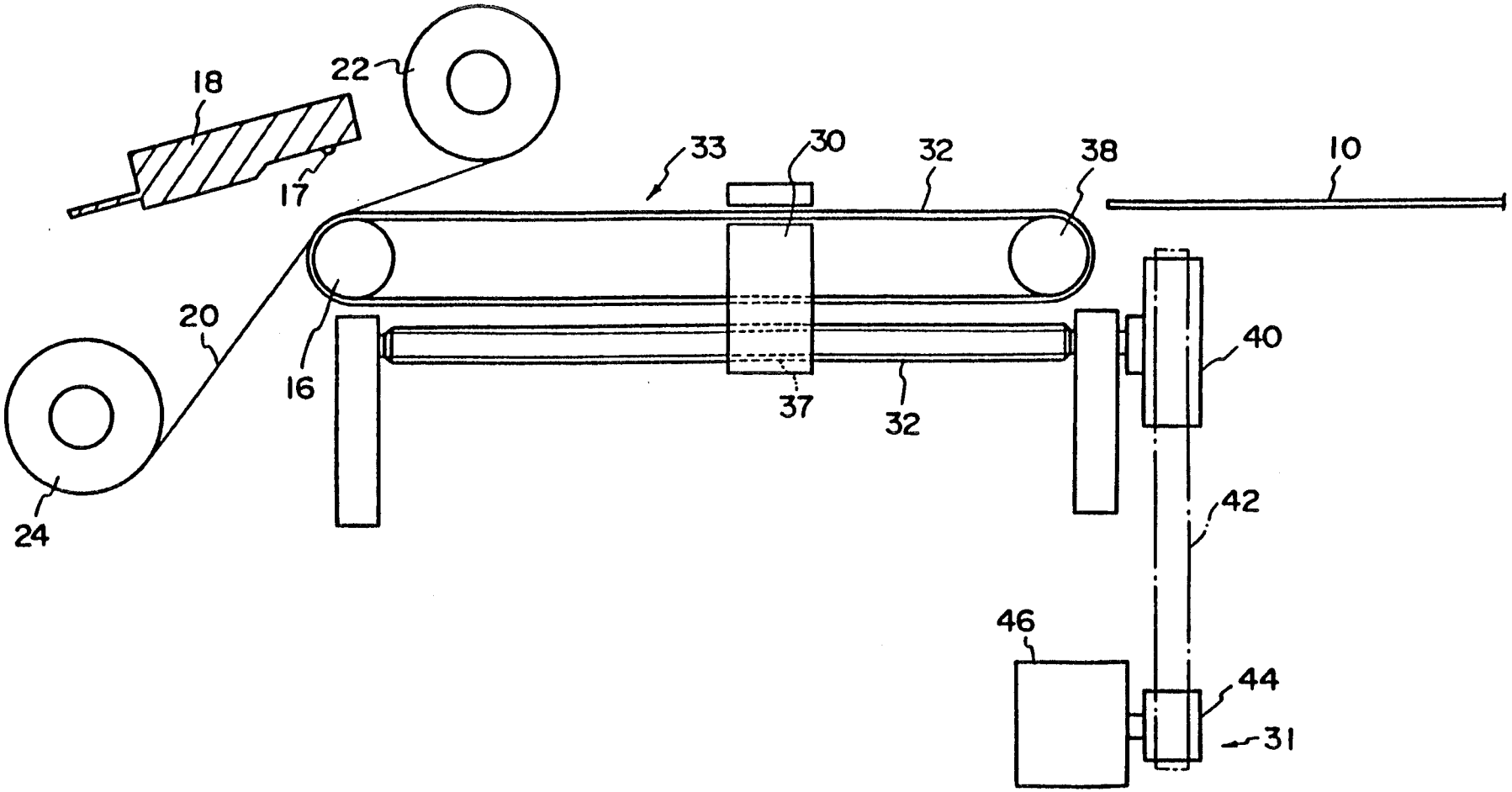
FIG. 1 is a schematic end view diagram of the general configuration of a first embodiment of the present invention.

A first embodiment of the invention will now be described with reference to the drawings. FIG. 1 is an end view of the general arrangement of the first embodiment of the color thermal printer according to the invention, and FIG. 2 is a plan view.

Figure 2:
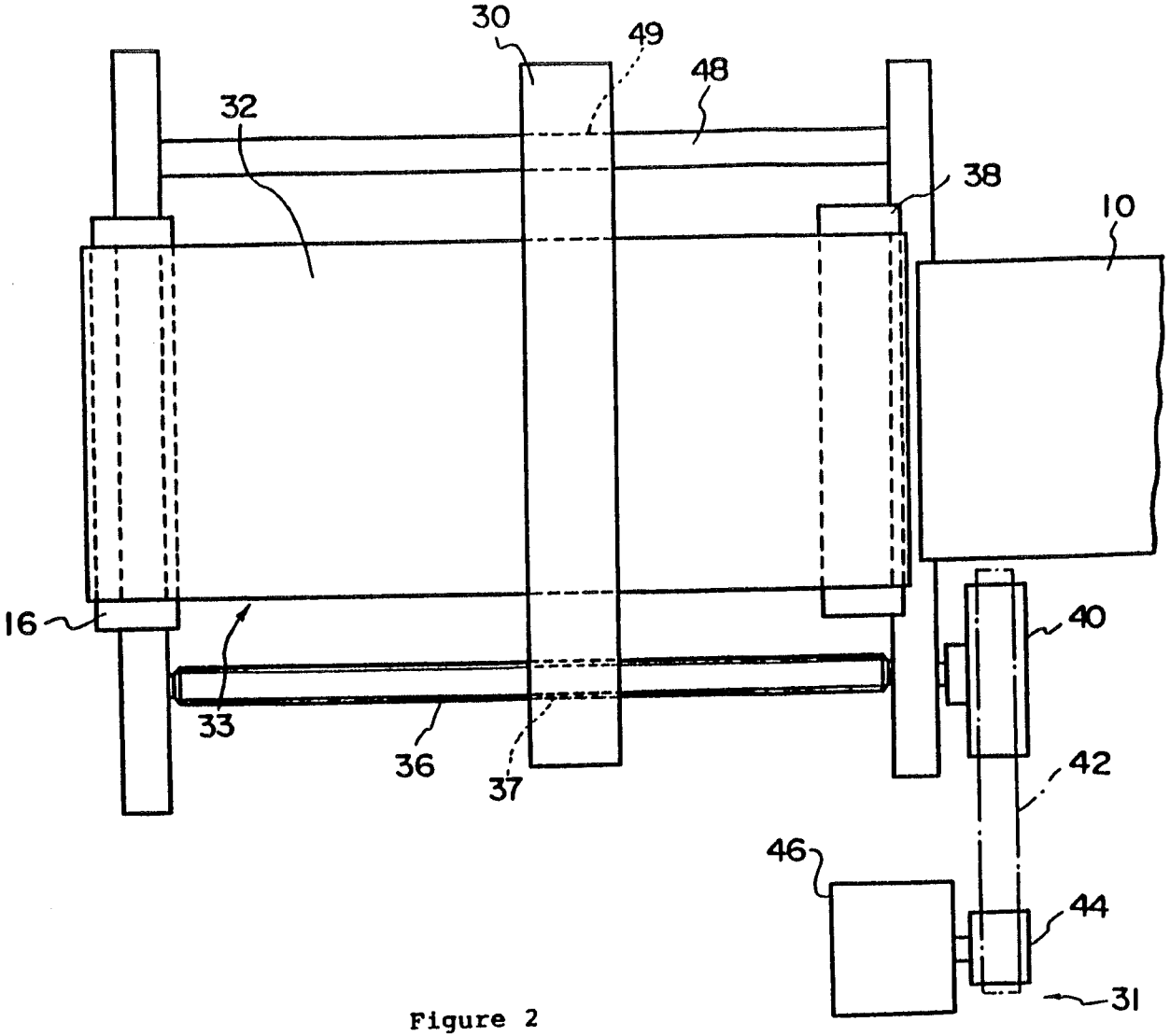
FIG. 2 is a plan view of the apparatus of FIG. 1.

With reference to the arrangement illustrated in FIGS. 1 and 2, a thermal print head 18 and a platen roller 16 for a printing section for effecting thermal transfer printing of paper 10. An ink donor film 20 is arranged so that it passes through the transfer section gap between the thermal print head 18 and the platen roller 16, in superposed alignment with the paper 10.

The thermal print head 18 is swingably supported to allow it to be swung to press a printing element section 17 into contact with the platen roller 16 and retract the printing element section 17 away from the platen roller 16. The printing element section 17 is provided with heating elements which are used to selectively heat and transfer inks from the ink donor film 20.

The platen roller 16, which can rotate freely, receives and limits the pressure contact of the thermal print head 18, and at the same time provides a support for, while allowing transport of, the paper 10 in contact with the surface of the platen roller 16 and the ink donor film 20 which is in superposed alignment with the paper 10 with which it is moved in unison. The platen roller 16 has a small diameter which provides a radius of curvature which ensures that the printing element section 17 is subjected only to the amount of pressure required for the transfer printing to take place.

A rotatable paper transport means 33 is constituted by an endless belt 32 running between the platen roller 16 and a support roller 38 arranged parallel to the platen roller 16 from which it is spaced by a prescribed distance. A gripper 30 is arranged on the paper transport means 33 at the transport side of the belt 32. As can be seen from FIG. 1, the gripper 30 consists of two vertically-arranged parts which can be brought together to grip the belt 32 and the paper 10, or opened to release them, by means of a cam, solenoid or other such operating means. A gripper moving means 31 is provided for controlled positioning of the gripper within a prescribed distance from the transfer section gap through which the thermal print head 18 and platen roller 16 are transported. Operating the gripper moving means 31 while the belt 32 and paper 10 are gripped by the gripper 30 causes the belt 32 to move together with the gripper 30, thereby providing a positive transport action regardless of the size, thickness or stiffness of the paper 10.

With reference to FIG. 2, the gripper moving means 31 is comprised of a bore screw 36 which can be rotated to horizontally move the gripper 30 by means of an engagement with a threaded groove 37 formed in the end portion of the gripper 30, a follower pulley 40 which rotates with the bore screw 36, a belt 42 which transmits rotational force to the follower pulley 40, and a drive pulley 44 and motor 46 for driving the belt 42.

The motor 46 can operate in forward or reverse mode, and the speed, starting and stopping of the motor can be controlled. The rotational force of the motor 46 is transmitted to the bore screw 36 via the drive pulley 44, belt 42 and follower pulley 40, the gripper 30 with the threaded groove 37 can be moved horizontally (with reference to FIG. 2) to a required position in a direction and at a speed that are in accordance with the rotational direction and speed of the bore screw 36. To achieve smooth translational movement of the gripper 30, a guide shaft 48 is provided in a parallel arrangement with the bore screw 36. Specifically, a shift hole 49 is provided in the gripper 30 in which the guide shaft 48 is movably mounted.

Figure 3:
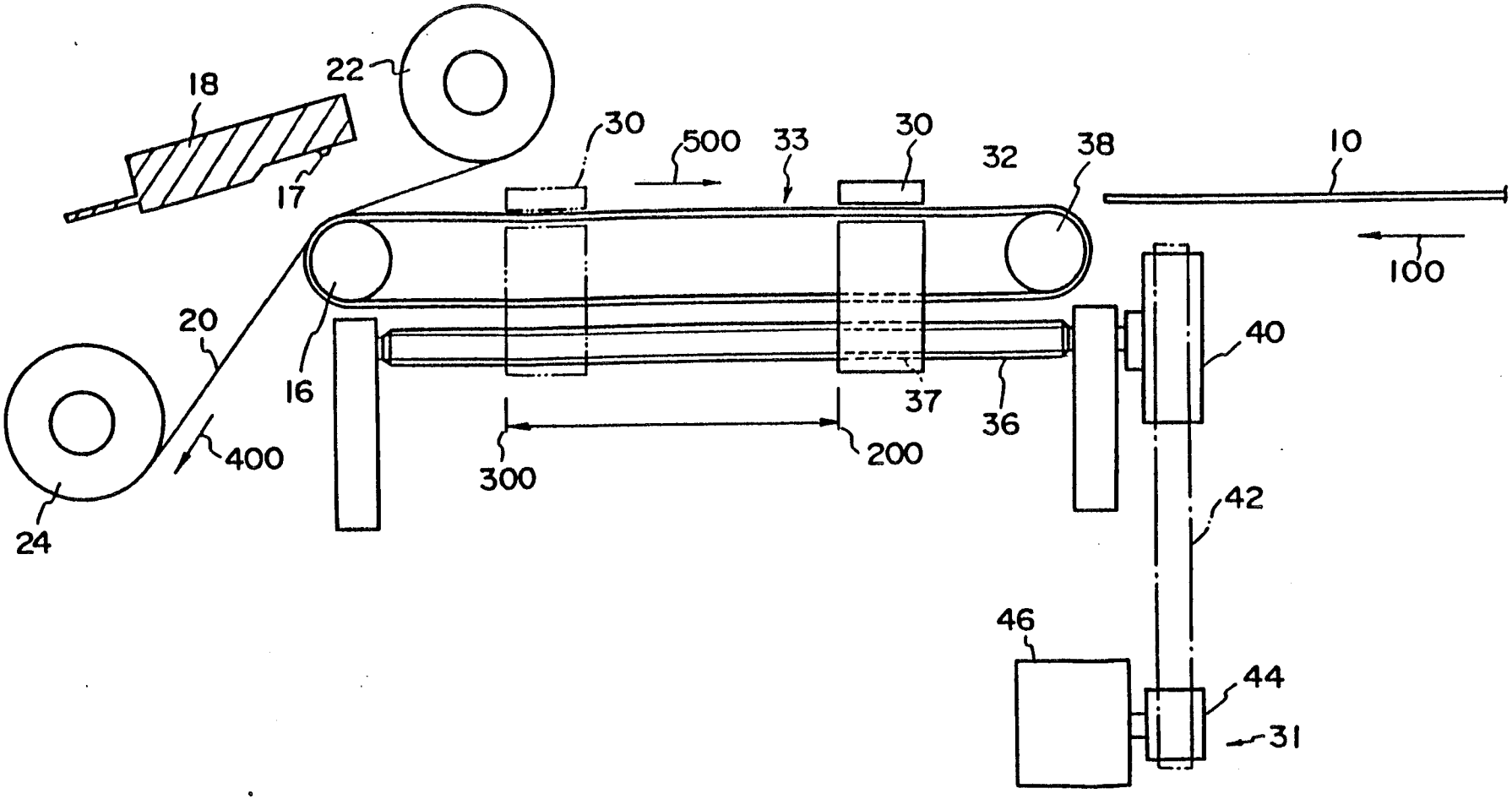
FIG. 3 is an end view illustrating the operation of the first embodiment.

The operation of the color thermal printer thus configured will now be described with reference to FIG. 3. Paper 10, moving in the direction indicated by arrow 100 in FIG. 3, enters the space between the jaws of the gripper 30, is gripped by the gripper 30 and moved by the gripper moving means 31 to the print start position 300 which is in the vicinity of the transfer section and is indicated by a double-dot broken line. The gripper 30 then opens and is moved in the direction indicated by the arrow 500 by an amount that corresponds to the printed page length of the paper 10, and the gripper 30 is then closed again. Holding the paper 10 and the belt 32 thus, the gripper 30 is then moved to the print start position 300 again, causing the paper 10, together with the belt 32, to traverse the space between the thermal print head IS and the platen roller 16 in the direction in which the paper 10 is ejected, which is indicated by the arrow 400, then come to a stop. During this operation the thermal print head 18 is in its position of retraction from the platen roller 16, and the ink donor film 20 is wound on to the prescribed position by the film rollers 22 and 24.

Next, to start printing the thermal print head 18 is swung into the printing position in which it is pressing the donor film 20 and the paper 10 against the platen roller 16. In this operation, the paper 10 gripped by the gripper 30 is moved in the direction indicated by the arrow 500 at a speed that depends on the printing, until the gripper 30 arrives at the end-of-printing position 200. During this movement, heat is applied by the printing element section 17 to selectively transfer a first color (which will be assumed here to be yellow) from the ink donor film 20 to the paper 10.

When the printing of the first color is thus completed, the gripper 30, gripping the paper 10, is moved to the print start position 300. During this movement, the thermal print head 18 is in the retracted position shown in FIG. 3 to permit the paper 10 to be transported, and the ink donor film 20 is wound on to position it for the printing of the second color, which in this example is magenta. The second color is printed in the same way as the first color.

To complete a color printing which uses three colors (yellow, magenta, cyan) would require the above sequence of operations to be repeated three times, a four-color printing four times, and so forth, superposing the colors. To ensure good-quality color printing, therefore, the paper has to be located at exactly the same print start position for each of the colors concerned, and the paper must be transported at precisely the same speed for each color.

In this invention as described with reference to the above embodiment, the gripper 30 can be positioned with the requisite precision by the rotation of the bore screw 36 driven by the controlled operation of the drive motor, thereby enabling color printing to be effected with no loss of color registration. Also, as the gripper 30 can be moved to the vicinity of the transfer section at the platen roller 16 while gripping the paper 10 and belt 32, the length of the printed portion can be readily varied, within the limits of the range of movement of the gripper 30.

Furthermore, using a small-diameter platen roller 16 reduces the contact area of the thermal print head 18 and concentrates the pressure on the printing element section 17 of the thermal print head 18, enabling the contact pressure to be kept down to the level actually needed for good-quality printing. This makes the heating elements of the print head less susceptible to damage and therefore extends their life. Using a small-diameter platen roller also makes the thermal print head more compact and reduces costs.

Figure 4:
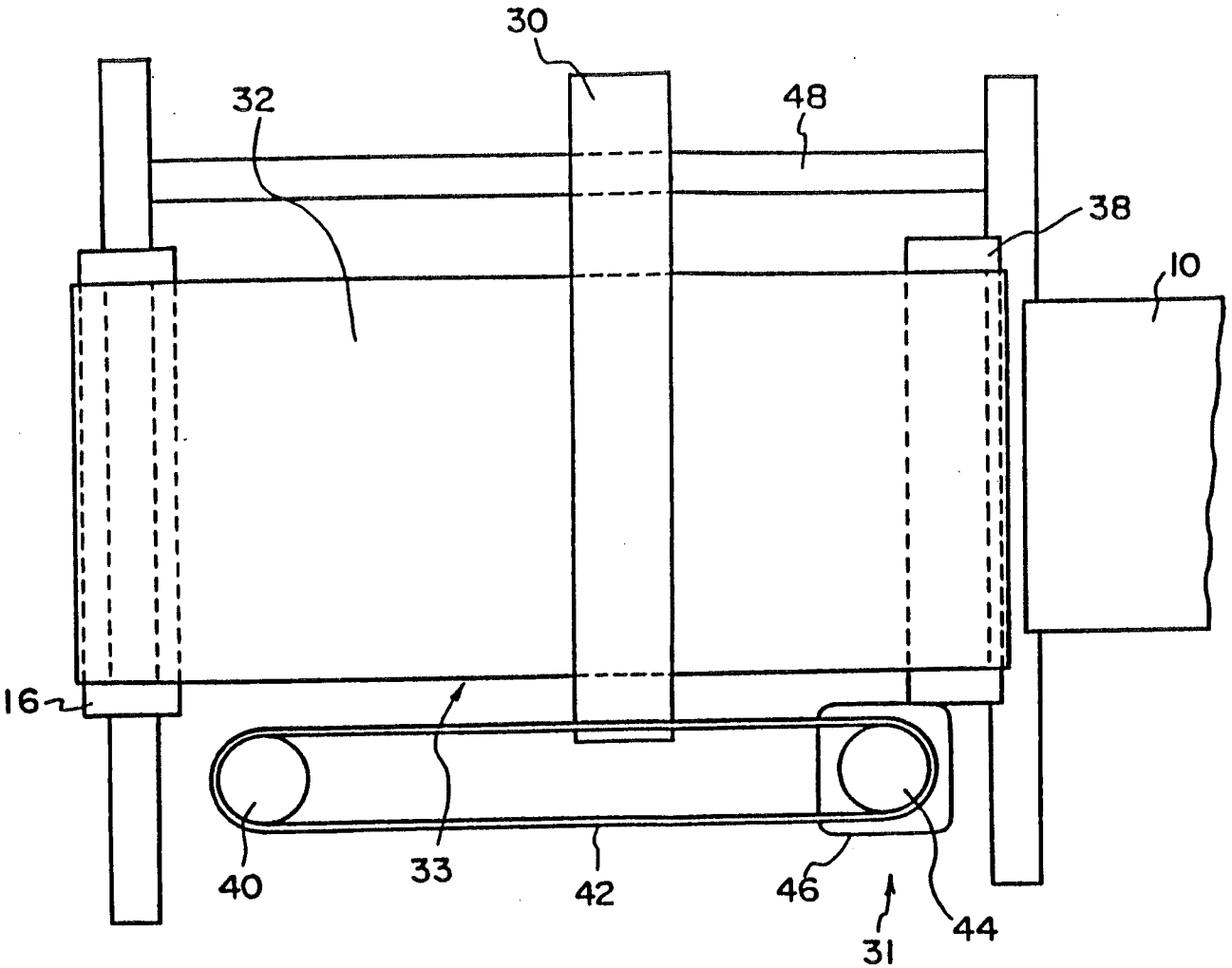
FIG. 4 is a plan view of the arrangement of another embodiment.
Figure 5:
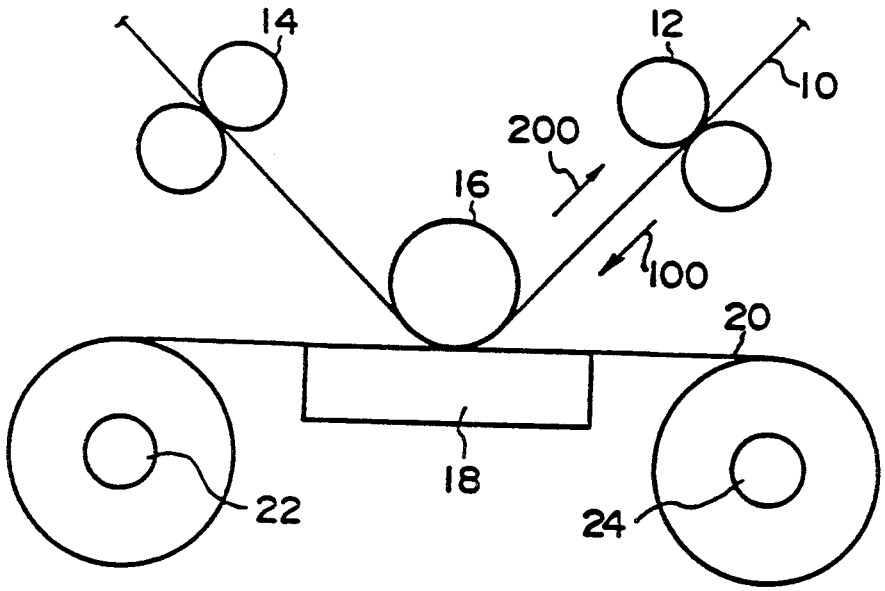
FIG. 5 is a diagram of a prior-art reciprocating system.
Figure 6:
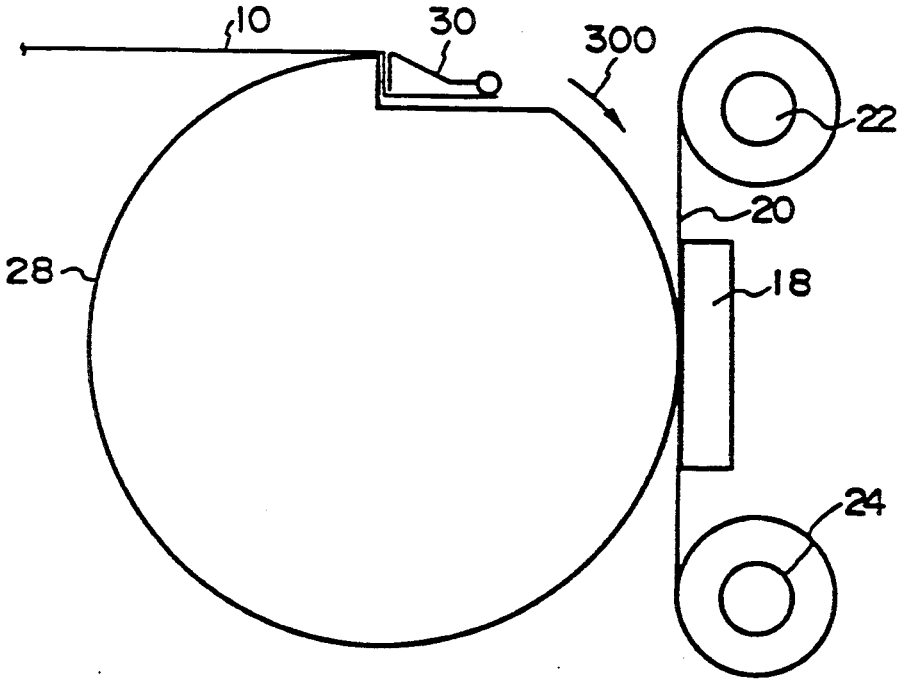
FIG. 6 is a diagram of a prior-art unidirectional system.

FIG. 4 is a plan view of a second embodiment of the color thermal printer. In the gripper moving means 31 of this embodiment, instead of the bore screw arrangement of the first embodiment, an endless belt 42 running between drive pulley 44 and follower pulley 40 is used to transmit the rotational force of the motor 46. The gripper 30 is fixed to one point on the belt 42 to enable the horizontal position of the gripper 30 to be controlled by the horizontal movement of the belt 42.

The implementation of the gripper moving means is not limited to the bore screw or belt drive arrangements described above, but may employ other arrangements such as, for example, a cylindrical cam arrangement or a linear stepper motor arrangement to move the gripper 30.

The invention has been described in detail with reference to the figures, however, it will be appreciated that variations and modifications are possible within the spirit and scope of the invention.

What is claimed is:

1. A color thermal printer comprising: a printing section constituted by a platen roller and a thermal print head arranged in opposition to the platen roller;

an ink donor film provided with a plurality of colored inks which passes through a transfer section space between the platen roller and the thermal print head, superposed on a paper print medium with which the ink donor film is moved in unison, the thermal print head being used to selectively transfer the inks of the ink donor film to the paper;

a rotatable paper transport means formed by an endless belt which runs between the platen roller and a support roller arranged parallel to the platen roller from which it is spaced by a prescribed distance;

a gripper for releasably gripping the paper and the part of the belt of the paper transport means on which the paper is transported;

and a gripper moving means which provides positional control of the gripper within a prescribed range from the vicinity of the transfer section;

wherein the gripper is used to grip the paper and the belt of the paper transport means while being moved by the gripper moving means so as to thereby transport and print the paper.

2. The printer of claim 1 wherein said gripper moving means includes a bore screw engaging said gripper means and a motor drivingly coupled to said bore screw.

3. The printer of claim 1 wherein said gripper moving means includes an endless belt fixed to said gripper means and a motor drivingly coupled to said belt.

* * * * *